United States Patent [19]

Reiss

[11] 4,444,395

[45] Apr. 24, 1984

[54] GOLF CLUB

[76] Inventor: Morton M. Reiss, 16220 NE. 13th Ave., North Miami Beach, Fla. 33162

[21] Appl. No.: 435,756

[22] Filed: Oct. 21, 1982

[51] Int. Cl.[3] ..... A63B 69/36

[52] U.S. Cl. ..... 273/171; 273/174

[58] Field of Search ..... 273/168, 169, 172, 171, 273/173, 174, 167 D, 167 F

[56] References Cited

U.S. PATENT DOCUMENTS

| | | | |
|---|---|---|---|
| 1,133,129 | 3/1915 | Govan | 273/171 |
| 3,042,405 | 7/1962 | Solheim | 273/168 X |
| 3,305,235 | 2/1967 | Williams | 273/169 X |
| 3,516,674 | 6/1970 | Scarborough | 273/171 X |
| 3,771,788 | 11/1973 | Hurley et al. | 273/168 X |

*Primary Examiner*—George J. Marlo

*Attorney, Agent, or Firm*—Malin & Haley

[57] ABSTRACT

A golf club used in putting a golf ball having an elongated head constructed of relatively lightweight, preferably aluminum, material at its central portion and having relatively heavier metal end portions. In proportion to the diameter of a standard U.S.G.A. golf ball, the central aluminum head portion is approximately 1½ to 3 times as long; the end portions are approximately ½ to 1½ times as long. The weight distribution between the head central portion in relation to the heavier metal end portions is such that 60% to 90% of the total weight of the elongated head is contained in the end portions. This weight distribution increases the rotational inertial stability of the club head, improving a golfer's putting accuracy. The central portion of the head is connected to a conventional golf club shaft for use.

7 Claims, 3 Drawing Figures

GOLF CLUB

BACKGROUND OF THE INVENTION

This invention relates generally to golf clubs and more particularly to the golf club used in putting a golf ball across a green.

The art of golf ball putting has been enhanced by various club head designs which are intended to achieve a particular functional result. One line of design effort is aimed at maximising the rotational inertia of the club head about the "sweet spot" or center of percussion of the head. This increase in rotational inertia improves the golfer's putting consistency by reducing unintentional club head rotation during the putting stroke and particularly at the instant of contact with the golf ball if contact is away from the center of percussion. Such off-center impact causes club head rotation and a misdirected golf ball. One such club head design is disclosed in U.S. Pat. No. 4,174,110 which includes inertia balls or masses attached to the ends of the club head. This device, however functional, is aesthetically lacking. Another inertial club head is disclosed in U.S. Pat. No. 3,873,094 which includes a plastic light transmitting medium with weights embedded or molded therein to achieve a particular aesthetic effect. U.S. Pat. No. 3,966,210 discloses a golf club head which also includes weights embedded near the ends of the club head, but includes shape means to house the embedded weights which may be aesthetically displeasing and spaces the weight means rearward from the plane or striking face of the club head. Likewise, the golf club taught in U.S. Pat. No. 1,901,562 includes embedded weights held within the club head by metal plates, the weights being spaced apart from one another and the face of the club head.

The instant invention provides a golf club putter having a head design which includes heavier formed ends to maximize club head rotational inertia in relation to particular club head size and weight proportions while also providing an aesthetically acceptable overall shape. Further, the heavier ends are achieved, not with weights embedded into a separate carrying medium, but by relatively heavier material forming the entire end portions of the head, and a lighter material forming the entire club head central portion, including the striking surfaces.

BRIEF DESCRIPTION OF THE INVENTION

A golf club used in putting a golf ball having an elongated head constructed of relatively lightweight, preferrably aluminum, material at its central portion and having relatively heavier metal end portions. In proportion to the diameter of a standard U.S.G.A. golf ball, the central aluminum head portion is approximately 1½ to 3 times as long; the the portions are approximately ½ to 1½ times as long. The weight distribution between the head central portion in relation to the heavier metal end portions is such that 60% to 90% of the total weight of the elongated head is contained in the end portions. This weight distribution increases the rotational inertial stability of the club head, improving a golfer's putting accuracy by increasing the size of the "sweet spot" and increasing the club head's resistance to rotation when a ball is struck slightly away from the center of the "sweet spot." The head is connected to a conventional golf club shaft for use.

It is an object of this invention to provide a golf club for putting having a relatively large "sweet spot" for improved putting performance.

It is another object of this invention to provide a golf club for putting with increased rotational inertia, providing additional resistance to undesirable club head rotation when swing or impacted against a golf ball.

In accordance with these and other objects which will be apparent hereinafter, the instant invention will now be described with particular reference to the accompanying drawings.

PREFERRED EMBODIMENT OF THE INVENTION

Figure 1:
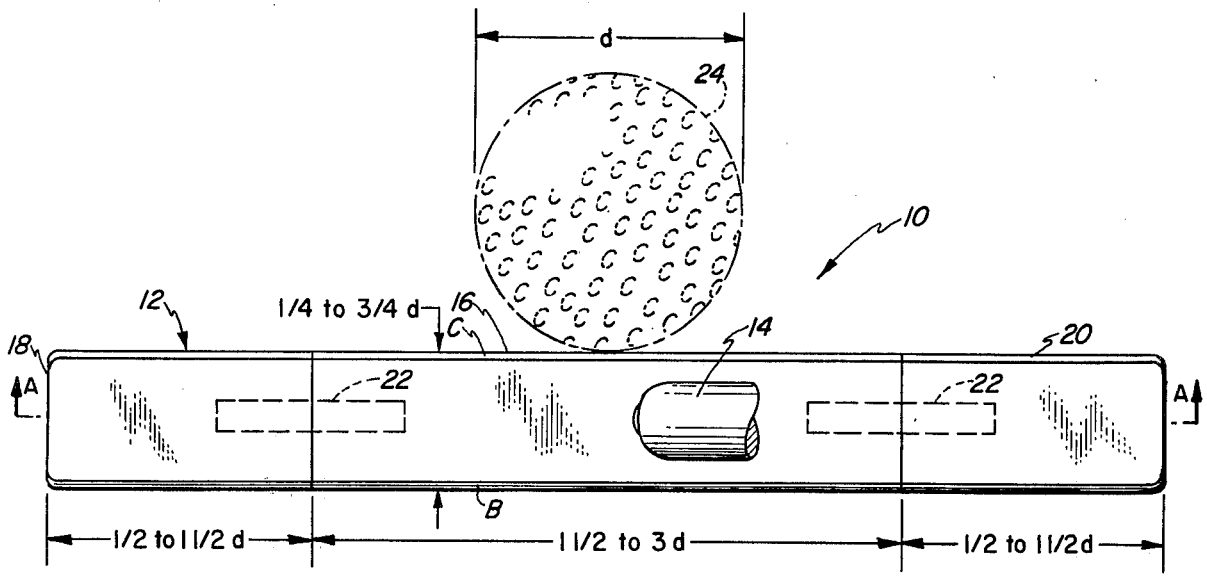
FIG. 1 is a plan view of the instant invention in relation to a golf ball.
Figure 2:
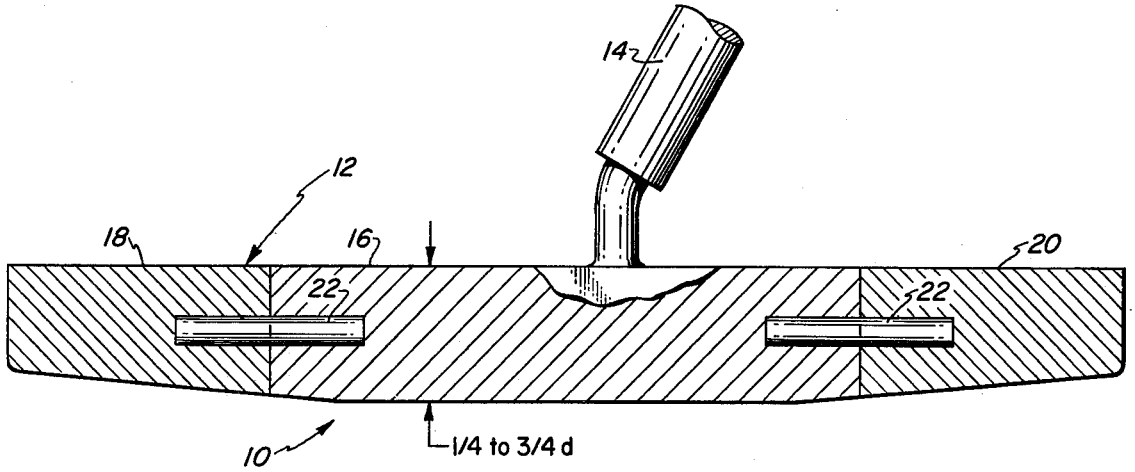
FIG. 2 is a side elevation partial sectional view through A—A in FIG. 1.
Figure 3:
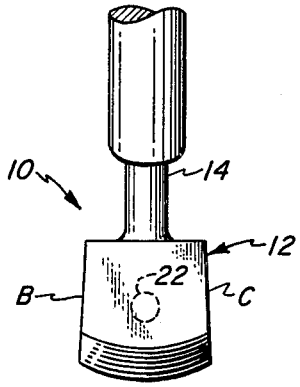
FIG. 3 is an end elevation view of the instant invention.

Referring now to the drawings, the instant invention is shown generally at 10 and includes an elongated golf club head 12 and a shaft or holding means 14 attached to the top of the club head 12 at a suitable angle for use in putting. A golf ball 24 of standard U.S.G.A. size is shown adjacent the striking surface of the club head to, in part, show club head size and proportion.

The elongated club head 12 includes a lightweight central section 16 to which the shaft 14 is attached. This central section 16 may be constructed of any relatively less dense rigid material such as aluminum, plastic, or the like. This material forms the club head's ball-striking surfaces B and C as well. Connected at each end of the elongated central portion 16 is an end portion 18 and 20, the outer surfaces of which form the final contour of those portions of the club head. These end portions 18 and 20 are molded or fashioned of relatively more dense, heavier material than the central portion 16. Such heavier material might be brass, bronze, lead, a steel or stainless material, or the like. The importance in the material selection for each end portion 18 and 20, which end portions need not be of similar heavier material, and the central portion 16, as well as the proportions of each and overall sizing of the club head, is to achieve 60% to 90% of the entire club head weight concentrated at these end portions, not necessarily in equal amounts.

As part of this disclosure to achieve the above-stated weight distributions, certain club head dimensional features, in relation to a standard U.S.G.A. golf ball, are disclosed. The length of the central portion 16 may be from 1½ to 3 times the diameter of a standard golf ball. The length of each end portion 18 and 20, again not necessarily equal, may be from ½ to 1½ times the diameter of a standard golf ball. Club head height and width may be within the range of ¼ to ¾ times a standard golf ball diameter.

The end portions 18 and 20 may be connected to the central portion 16 by interconnecting pins 22 as shown and/or may be attached at their interface by any adhesive means to achieve a permanent attachment therebetween. Alternately, pins 22 may be replaced by threaded shafts (not shown) matably engagable into each end portion and the ends of the central portion positioned substantially as are the pins 22. However, by this means, the end portions may be interchangeable so that the user may alternate various size and weight end portions to achieve tailored club performance.

The golf ball striking surfaces B and C may be generally symmetrical about the longitudinal vertical central plane of the club head to provide for use by both right-handed and left-handed golfers.

The instant invention has been shown and described herein in what is considered to be the most practical and preferred embodiment. It is recognized, however, that departures may be made therefrom within the scope of the invention and that obvious modifications may occur to a person skilled in the art.

What I claim is:

1. A golf club for putting, said golf club comprising:

a shaft having an upper end and a lower end, said shaft upper end for holding and swinging said golf club;

a club head having an elongated central portion and two end portions positioned at either end of said central portion, each of said portions including a striking surface adapted to impact a golf ball during a putting stroke;

said shaft lower end connected for use to said central portion at a suitable angle to said central portion;

means for connecting each of said two end portions to a different end of said central portion;

the weight of said two end portions being equal to 60 to 90 weight percent of the weight of said club head.

2. A golf club for putting, said golf club comprising:

a shaft having an upper end and a lower end, said shaft upper end for holding and swinging said golf club;

a club head having an elongated central portion formed of a first material and two end portions, formed of a second material more dense than said first material, positioned at either end of said central portion, each of said portions including a striking surface adapted to impact a golf ball during a putting stroke;

said shaft lower end connected for use to said central portion at a suitable angle to said central portion;

means for connecting each of said two end portions to a different end of said central portion;

said central portion having a length in an amount equal to 150 to 300 length percent based on the diameter of a standard golf ball;

each of said two end portions having a length in an amount equal to 50 to 150 length percent based on the diameter of a standard golf ball;

said club head having a width and height each in an amount equal to 25 to 75 length percent based on the diameter of a standard golf ball.

3. A golf club as set forth in claim 2, wherein:

the weight of said two end portions being equal to 60 to 90 weight percent of the weight of said club head.

4. A golf club as set forth in claim 1, wherein:

said means for connecting each of said two end portions is releasable;

each of said two end portions is replaceable with similar or different sized said end portions.

5. A golf club as set forth in claim 2, wherein:

said means for connecting each of said two end portions is releasable;

each of said two end portions is replaceable with similar or different sized said end portions.

6. The club of claim 1, wherein:

said central portion comprises a flat surface means for striking a golf ball, and a pair of flat end surfaces, each said end surface being perpendicular to said flat surface, said two end portions each has additional flat surfaces and additional flat end surfaces perpendicular to said additional flat surfaces, wherein said additional flat surfaces of said two end portions, and the flat surface of said elongated central member, constitute a single flat face when said two end portions are mounted on said elongated central portion with said flat end surfaces of said central portion abuttingly attached to said additional end surfaces of said two end portions.

7. The club of claim 2, wherein:

said central portion comprises a flat surface means for striking a golf ball, and a pair of flat end surfaces, each said end surface being perpendicular to said flat surface, said two end portions each has additional flat surfaces and additional flat end surfaces perpendicular to said additional flat surfaces, wherein said additional flat surfaces of said two end portions, and the flat surface of said elongated central member, constitute a single flat face when said two end portions are mounted on said elongated central portion with said flat end surfaces of said central portion abuttingly attached to said additional end surfaces of said two end portions.

* * * * *